US008267265B2

(12) United States Patent
Giraud

(10) Patent No.: US 8,267,265 B2
(45) Date of Patent: Sep. 18, 2012

(54) UNITARY CONTAINER AND FLIP-TOP CAP ASSEMBLY HAVING CHILD RESISTANT SAFETY FEATURES

(75) Inventor: Jean-Pierre Giraud, Paris (FR)

(73) Assignee: CSP Technologies, Inc., Amsterdam, NY (US)

( * ) Notice: Subject to any disclaimer, the term of this patent is extended or adjusted under 35 U.S.C. 154(b) by 725 days.

(21) Appl. No.: 11/909,522

(22) PCT Filed: Mar. 24, 2006

(86) PCT No.: PCT/US2006/010842

§ 371 (c)(1),
(2), (4) Date: Oct. 14, 2009

(87) PCT Pub. No.: WO2006/102601

PCT Pub. Date: Sep. 28, 2006

(65) Prior Publication Data

US 2010/0044378 A1 Feb. 25, 2010

Related U.S. Application Data

(60) Provisional application No. 60/665,004, filed on Mar. 24, 2005.

(51) Int. Cl.
*B65D 55/02* (2006.01)
*B65D 51/04* (2006.01)

(52) U.S. Cl. ..... 215/216; 220/315; 220/810; 220/820; 220/833; 220/834; 220/835; 220/836

(58) Field of Classification Search ..... 220/315, 220/810, 820, 833, 834, 835, 836; 215/216
See application file for complete search history.

(56) References Cited

U.S. PATENT DOCUMENTS 4,444,326 A 4/1984 Musel et al.

(Continued)

FOREIGN PATENT DOCUMENTS

EP 0 084 617 8/1983
WO 97/37900 10/1997

OTHER PUBLICATIONS

International Preliminary Report on Patentability for International Patent Application No. PCT/US2006/010842, dated Oct. 4, 2007.

(Continued)

*Primary Examiner* — Anthony Stashick
*Assistant Examiner* — Madison L Wright
(74) *Attorney, Agent, or Firm* — McAndrews, Held & Malloy, Ltd.

(57) ABSTRACT

Containers with child resistant safety caps are disclosed herein. In one embodiment, the cap contains (1) an overlay and (2) a solid base. The overlay fits around at least a portion of the cap's solid base. At an end of the overlay is a thumb tab for facilitating the opening and closing of the cap. The overlay also contains a skirt that is perpendicular to the thumb tab. The skirt of the overlay contains a tab. At the end of the solid base proximal to the location of the tab on the overlay (when the cap is in the closed position) the solid base contains a notch. When the cap is shut, the overlay is secured around the solid base. If an upward force is only applied to the thumb tab, and then the overlay is lifted up, while the solid base of the cap remains secured to the container. If an upward force is applied to the thumb tab while simultaneously, sufficient inward force is applied to tab on the overlay to contact and secure the tubular skirt of the cap, then the solid base of the cap is simultaneously lifted up along with the overlay, thereby opening the container. In one embodiment, the overlay contains a top. In another embodiment, the overlay does not contain a top.

12 Claims, 9 Drawing Sheets

U.S. PATENT DOCUMENTS

| | | | | |
|---|---|---|---|---|
| 4,925,041 | A | 5/1990 | Pehr et al. | |
| 5,462,183 | A | 10/1995 | Rohr et al. | |
| 2005/0023285 | A1* | 2/2005 | Keung | 220/835 |
| 2007/0205176 | A1* | 9/2007 | Karp | 215/237 |
| 2008/0083768 | A1* | 4/2008 | Luburic | 220/810 |

OTHER PUBLICATIONS

International Search Report corresponding to International Patent Application No. PCT/US2006/010842, dated Jul. 18,2006.

* cited by examiner

UNITARY CONTAINER AND FLIP-TOP CAP ASSEMBLY HAVING CHILD RESISTANT SAFETY FEATURES

CROSS-REFERENCE TO RELATED APPLICATIONS

This application claims priority to U.S. provisional application 60/665,004, filed Mar. 24, 2005. The priority application is incorporated by reference. The present invention relates to child-resistant safety caps and containers.

BACKGROUND OF THE INVENTION

There is an increasing awareness of the need to protect children from inadvertently gaining access to medications, especially prescribed medications. Ingestion of only one or two pills of a prescribed medication can prove fatal to a child. There is an increasing awareness of the necessity to provide containers for prescribed medications that are readily and easily opened by an adult, that is, any person having the cognitive ability to understand the instructions for opening a pill container, which requires certain manipulation and manual dexterity. Such persons are assumed to have the ability to understand that the act of opening a pill container to gain access to the prescribed medication is a deliberate action, and is only undertaken when there is a necessity to attain access to the prescribed medication in the pill container.

There are several conventional, so-called, "childproof" or "child-resistant" pill containers in the market, which are generally employed by dispensing pharmacists for use in filling prescriptions, where the prescription requires that the pharmacist dispense one or more of a plurality of pills, tablets, gel-caps, capsules, or the like. For example, the container may include a "push-and-turn" closure for pill containers, or an "arrow-alignment" closure for pill containers.

The "push-and-turn" system for pill containers conventionally refers to a system in which the closure or cap for the pill container must be pushed axially downwardly and rotated at the same time to open the container. The "arrow alignment" system for pill containers conventionally refers to a system in which an arrow on the closure or cap must be aligned with an arrow on the pill container, such as one which is embossed on the container, in order to open the container. However, these containers are often complicated for adults to use.

Conventional container assemblies of the type where the cap or closure is integral with the container may have a fixed protrusion (also referred to as a "thumb tab") attached to the cap that is configured to assist in the opening of the cap. More typically, this fixed protrusion is opposite the hinge, and thus, acts as a lever to allow the intended user to open the container when a sufficient force is applied under the fixed protrusion. However, these containers can be opened by a child.

Therefore it is an object of the invention to provide an improved container and cap system which is child resistant, yet easily opened by an adult.

BRIEF SUMMARY OF THE INVENTION

One aspect of the invention is a lift-top closure for removably seating on a rim of a container to form a child-resistant container. The closure has a lift-top cap having a web, a depending skirt, and a cap abutment on the skirt. In an embodiment, the cap abutment projects outward from the skirt. The cap is adapted to at least substantially cover and engage a rim of the container. In an embodiment the closure can have a cap hinge for securing the lift-off cap to the container.

The closure can include, in an embodiment, an overlay having a radially flexible tab having a rest position and a radially inwardly deflected working position. The tab is positionable substantially radially outside the cap abutment. The tab can include a tab abutment normally disengaged from the cap abutment when the tab is in its rest position. The cap abutment is engaged beneath the cap abutment for lifting the cap abutment when the tab is deflected to its working position. In an embodiment, the tab abutment projects inward from the tab. The overlay has a force-receiving element such as a thumb tab, a high-friction pad, or another arrangement for transmitting a manual lifting force to the overlay.

In an embodiment, the overlay can comprise a first portion having the tab and a second portion secured to at least one of the lift-off cap and the container. The tab can have a proximal portion and a distal portion In an embodiment, the proximal portion of the tab is integral with the body portion, and the distal portion of the tab has a periphery spaced from the body portion.

In an embodiment, the overlay can comprise at least a partial skirt overlying at least a portion of the skirt of the lift-top cap. In an embodiment, the first and second portions of the overlay, or either of them, can define the partial skirt.

In an embodiment, the overlay can have a hinge joining the overlay to at least one of the cap and the container. If provided, the hinge can enable the overlay to pivot between a lowered position, at which the tab abutment is positionable to engage the cap abutment when the tab is deflected to its working position, and a lifted position above the first position.

The cap is openable by deflecting the tab to engage the cap abutment with the tab abutment, while lifting the force-receiving element to raise the cap abutment to its lifted position.

In an embodiment, the closure can have a snap fitting including a portion on the overlay and a portion on the cap. The snap portions and can be selectively engageable to maintain the overlay in its lowered position and disengageable by an overlay lifting force to raise the overlay. In an embodiment, the overlay lifting force is less than the force sufficient to unseat the cap from a rim of the container.

In an embodiment, the child-resistant lift-top container assembly can have a container having a rim defining a mouth, as well as a lift-top cap, an overlay, a tab, a tab abutment, a force-receiving element, and an overlay hinge.

BRIEF DESCRIPTION OF THE DRAWINGS

FIG. 1A shows the container in the closed position. FIG. 1B shows the container with the overlay lifted, and the solid base in the closed position. FIG. 1C shows the container in the open position.

FIG. 3A shows the container in the closed position. FIG. 3B shows the container with the overlay lifted, and the solid base in the closed position. FIG. 3C shows the container in the open position.

DETAILED DESCRIPTION OF THE INVENTION

Figure 1A:
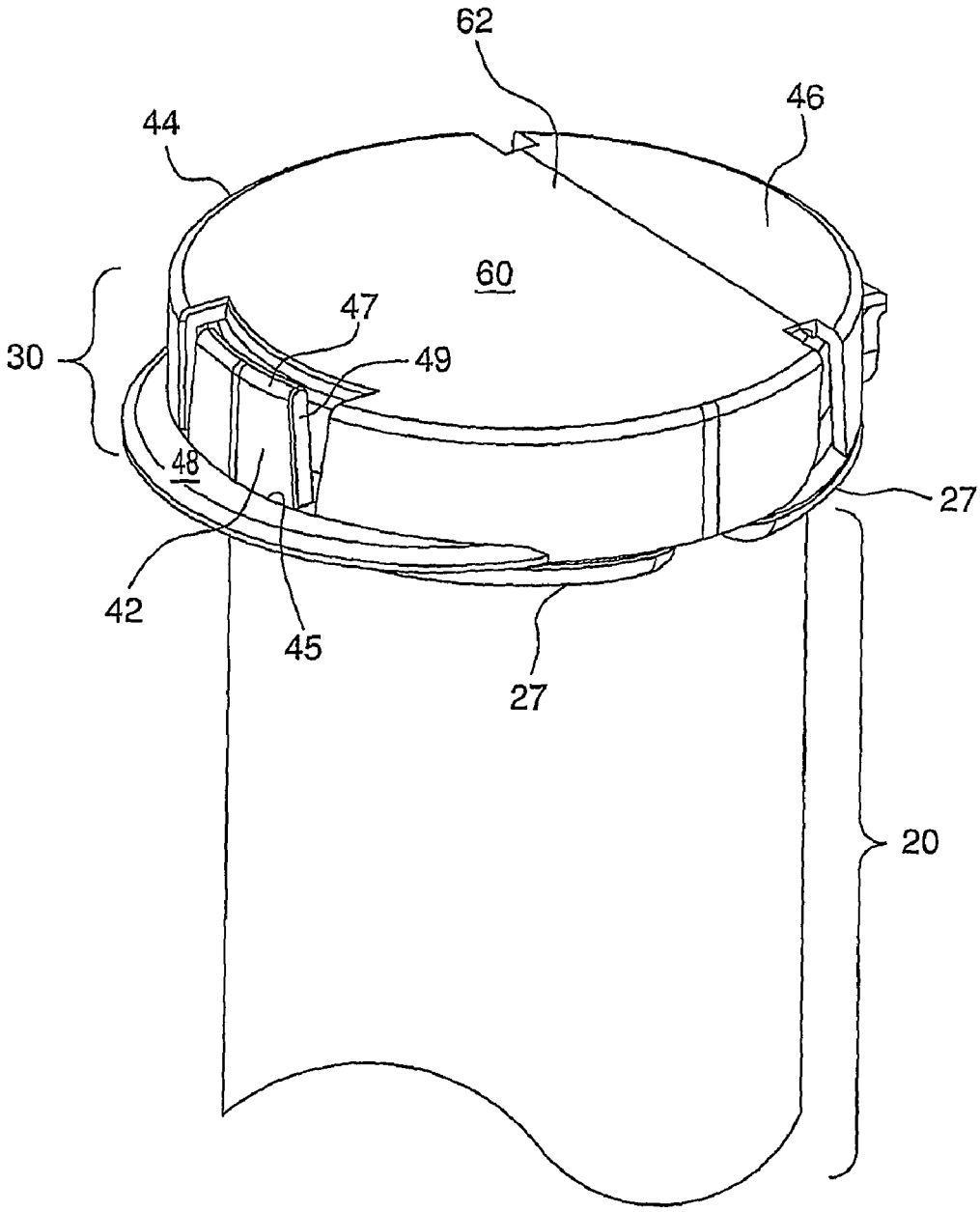
FIGS. 1A, 1B and 1C are perspective views of a container and cap assembly with an overlay with a top and a solid base beneath the overlay.

As generally used herein, a "child-resistant" cap or closure for a pill container means that the cap or closure was tested in the following manner. When a child-resistant package is tested by a group of five year old children, the child-resistant package cannot be opened by at least 85% of those children prior to a demonstration to them of the proper means of opening the package; and still cannot be opened by at least 80% of those children after they receive a demonstration of the proper means for opening the package. In the case where a child-resistant package is provided to a test group of adults, at least 90% of those adults must be capable of opening the package. Where the package is designed so that it may be re-closed, it can be re-closed by at least 90% of those adults but still cannot be opened by at least 85% of children to whom no demonstration of the proper method of opening the package has been given, nor by 80% of those children after a demonstration has been made.

II. Container and Cap Assembly

The container may have any shape that is suitable for storing medicaments. In the preferred embodiment, the container is in the shape of a cylinder, oval, square or rectangular, so long as the opening is to be sealed. Typically, the container is closed at one end and is open at the opposite end. Optionally, the container is open at both ends. Optionally, when the container is closed, the container is moisture tight.

In the embodiment in which the cap and container form a single piece, the cap is attached to the container by way of a hinge. The cap also has a mating sealing element that interfaces with the open end of the container, thereby forming a container and cap assembly.

The assembly is preferably molded of plastic. Suitable material for assembly includes plastics like thermoplastics such as polypropylene and polyethylene. The assembly may be produced in accordance with the operation disclosed in U.S. Pat. No. 4,783,056 to Abrams, U.S. Pat. No. RE37,676 to Abrams et al. or U.S. Pat. No. 6,303,064 to Abrams et al. The disclosures of these patents are incorporated herein by reference.

Optionally, the container includes a lining of a material that absorbs or releases materials. As an example, if the material absorbs water vapor, it may be included to keep the contents at a low relative humidity since any moisture that permeates through the seal or is present in the container would be absorbed. The lining material may be a desiccant entrained plastic. Suitable desiccant plastics include, but are not limited to those disclosed in U.S. Pat. Nos. 5,911,937; 6,214,255; 6,130,263; 6,080,350; 6,174,952; 6,124,006; and 6,221,446, all to Hekal. The disclosures of these patents are incorporated herein by reference. The lining may also release a gas, such as an inert gas that prevents oxidation of the enclosed medicament, a flavoring or fragrance, or moisture, in the case of a medicament that should not be allowed to dry out. The lining material may contain a fragrance, desiccant, gas, or antioxidant.

The container assembly may be produced using a two shot injection molding process or an in mold liner process. Optionally, the container assembly may be produced by assembling a molded container and a lining either automatically or manually.

Two embodiments of the child resistant container and cap assembly are depicted in FIGS. 1A-3C. As depicted in these figures, the assembly 10 has a container 20 having an internal cavity 22, an outer surface 24, an upper portion 26 and a lower portion 28. Optionally, the container also has a flange 27 projecting radially outwardly from the outer surface 24 of the container 20. The flange may be located in the upper portion 26.

The assembly 10 also has a cap 30 which has two main parts: (1) a solid base 32 and (2) an overlay 38. The solid base 32 has a tubular skirt 34 extending perpendicularly and outwardly around the outer periphery of the base 32. The tubular skirt 34 contains a prong 36. A hinge 50 is located on the side opposite from the prong 36. The hinge 50 is attached to the tubular skirt 34 and extends substantially perpendicular to and outward from the tubular skirt 34. Optionally, the hinge 50 may also be attached to the container flange 27.

The overlay 38 includes a tubular skirt 40 that is sized to fit over at least a portion of the solid base's tubular skirt 34. The tubular skirt 40 contains a tab 42 that is designed to contact and connect with the prong 36 when pushed. The overlay 38 has a first portion 44 and a second portion 46. At an end of the first portion 44 is thumb tab 48 for facilitating the opening and closing of the container. The thumb tab 48 extends substantially perpendicular to and outward from the tubular skirt 40. The second portion 46 covers the area proximal to where the cap 30 attaches to the container 20 via the hinge 50. In one embodiment, illustrated in FIGS. 1A-1C, the overlay also contains a top 60. The second portion 46 of the overlay is secured to the cap's solid base 32. A top hinge 62 connects the first portion 44 with the second portion 46 of the top portion. In another embodiment, illustrated in FIGS. 3A-3C, the second portion includes two hinges 54A and 54B that are located on opposite sides of the hinge 50.

Figure 1B:
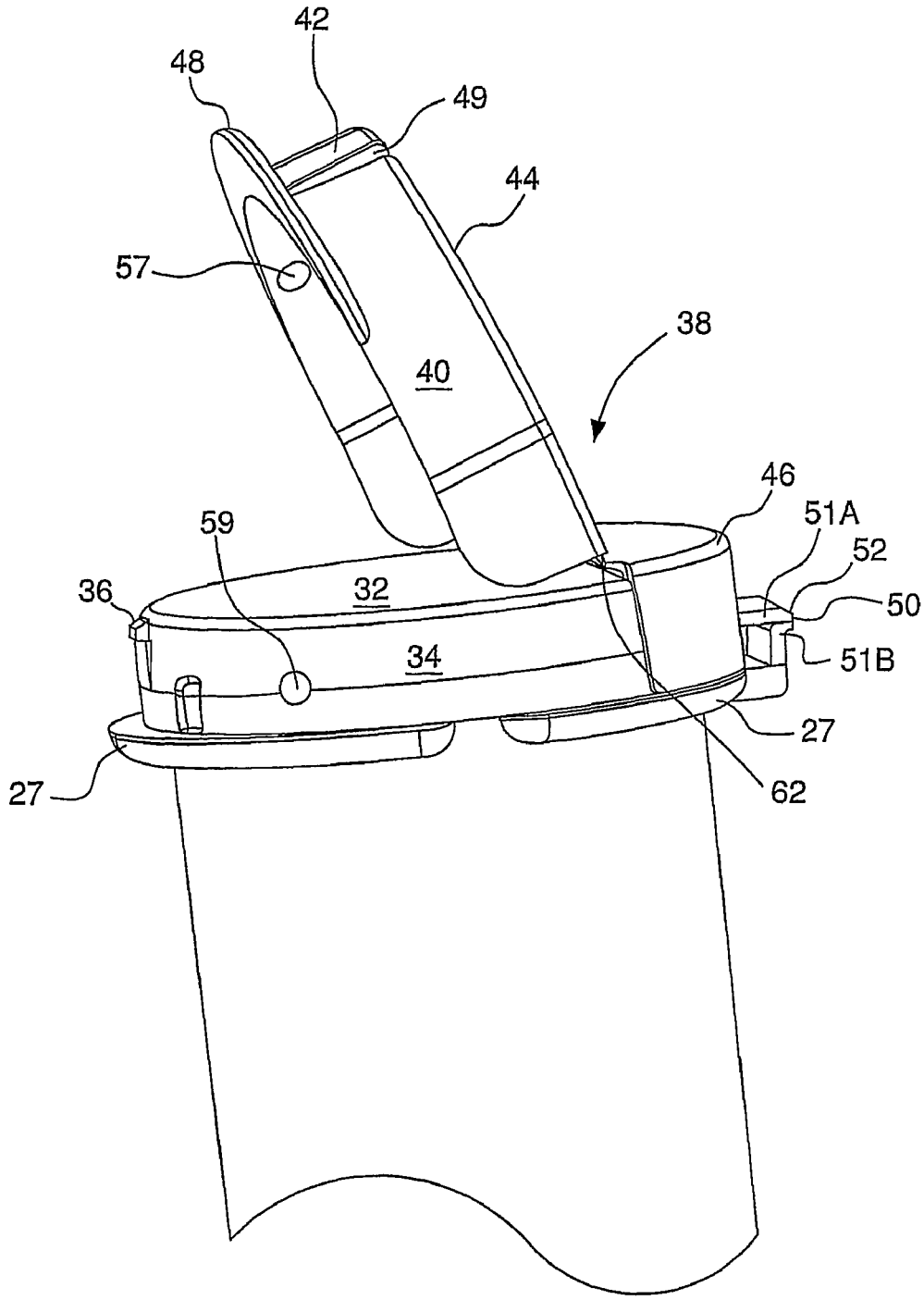
Figure 3A:
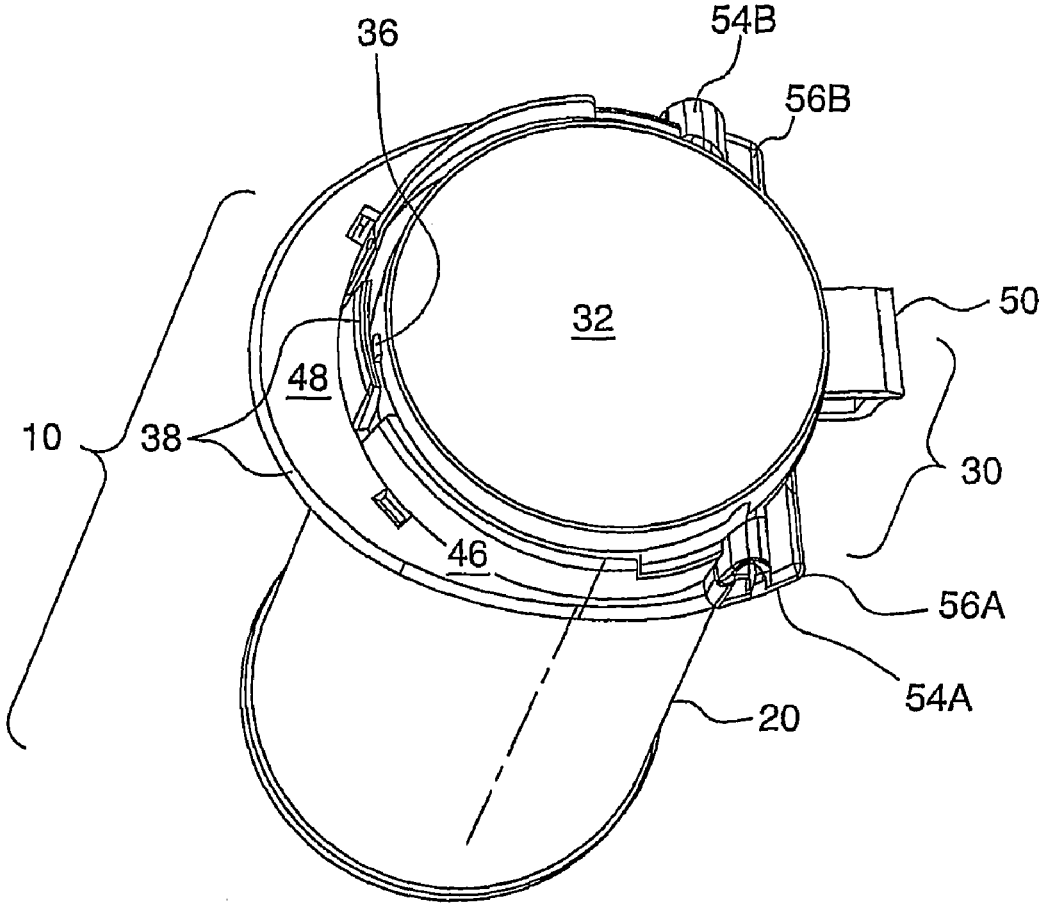
FIGS. 3A, 3B and 3C are perspective view of a container and cap assembly with an overlay without a top and a solid base beneath the overlay.
Figure 3B:
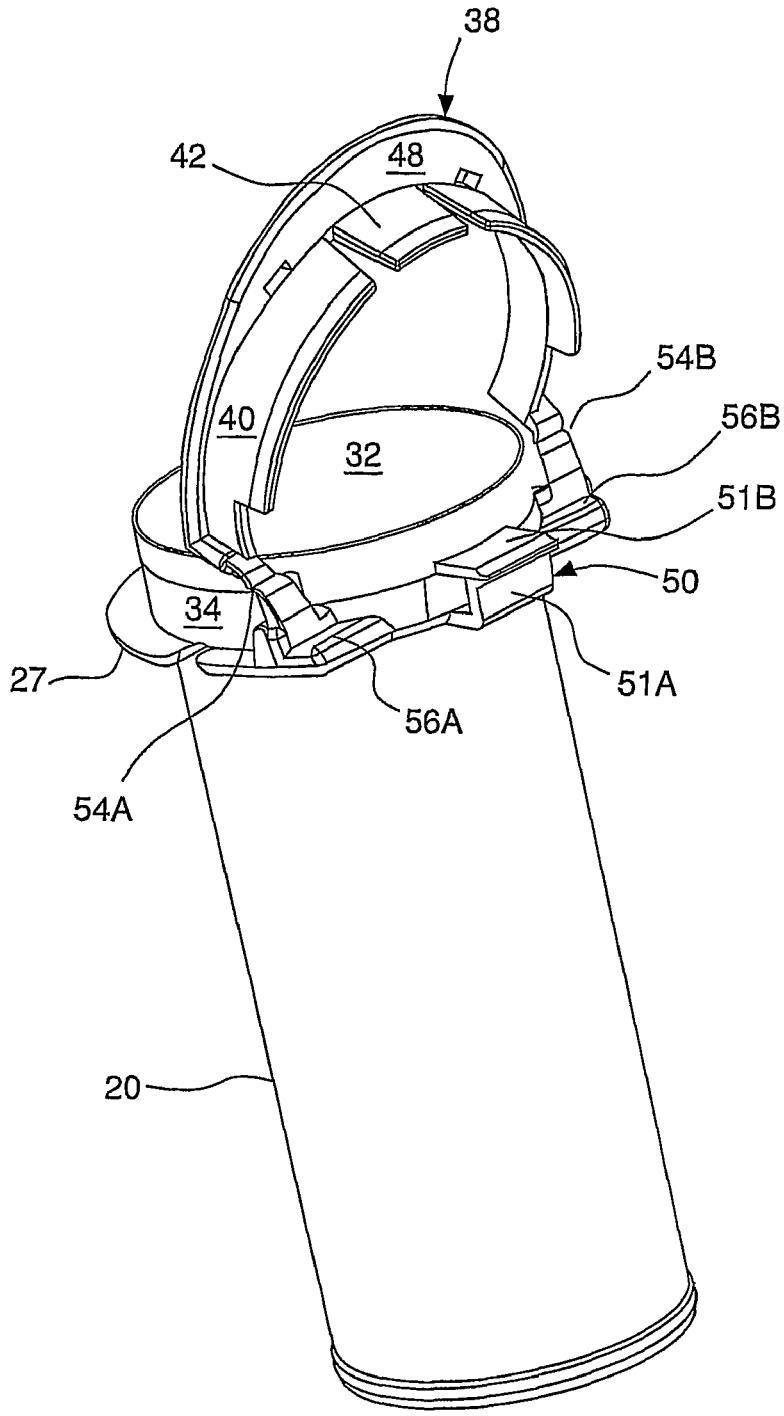
Figure 3C:
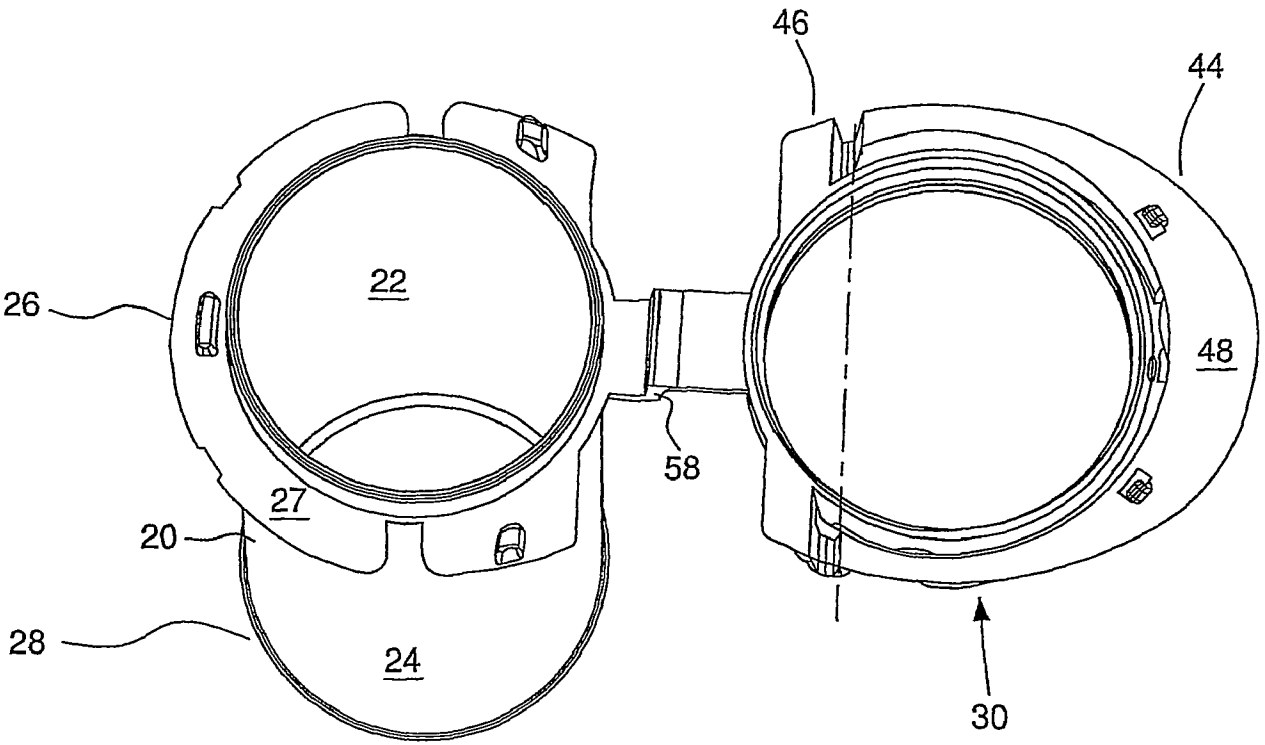

The hinges 50, 54A, 54B, and 62 may also have a recess that functions as a bending point during the opening and closing of the container or lifting of the overlay. In one embodiment, the recess is characterized by a relatively thinner section of plastic material which bridges thicker sections. As shown in FIGS. 3B and 3C, by way of example, in hinge 50, thicker sections, 51A and 51B surround a recess 52. In hinges 50, 54A and 54B, the recess is a location which bends relatively easily and folds when the cap is closed, and is the location where the hinge opens when the cap or overlay is opened. As illustrated in FIG. 1B, in hinge 50, 51A is attached to the tubular skirt 34 and 51B is attached to the container, optionally to the flange 27. In hinge 62, the recess is a location that bends relatively easily, is flat when the overlay is in contact with the solid base 32 (see FIG. 1A), and folds when the overlay is lifted separately from the solid base (see FIG. 1B). The tap may be formed of a shape-memory polymer, so that it lasts longer. (See e.g. U.S. Pat. No. 4,783,056 to Abrams, U.S. Pat. No. RE37,676 to Abrams et al. or U.S. Pat. No. 6,303,064 to Abrams et al.)

In an embodiment, the overlay 38 further can comprise a first portion 44 to which the tab 42 is secured. The tab 42 can have a proximal portion 45 and a distal portion 47 In an embodiment, the proximal portion 45 of the tab 42 is integral with the body portion, and the distal portion 47 of the tab 42 has a periphery 49 spaced from the body portion on each side by a notch.

In an embodiment, the overlay 38 can have a hinge 62 joining the first and second portions 44 and 46 of the overlay 38. The tab 42 is positionable substantially radially outside the cap abutment 36. In an embodiment, the overlay 38 can have a hinge (such as 62, 54A, 54B, or a combination of them) joining the overlay 38 to at least one of the cap 32 and the container 20. If provided, the hinge can enable the overlay 38 to pivot between a lowered position illustrated in FIG. 1A, at which the tab abutment 43 (best seen in FIG. 2) is positionable to engage the cap abutment 36 when the tab 42 is deflected radially inward to its working position, and a lifted position above the first position, illustrated in FIGS. 1B, 1C, and 3B.

The tab 42 can have a rest position, as illustrated in the Figures, at which the tab abutment 43 does not engage the cap abutment 36 and a radially inwardly deflected working position at which the tab abutment 43 is engaged beneath the cap abutment 36 for lifting the cap abutment 36. In an embodiment, the tab abutment 43 projects inward from the tab 42.

The degree of coverage of the overlay 38 over the solid base 32 may vary from what is shown in the Figures, as long as the overlay serves the desired function.

In an embodiment, overlay 38 contains a top 60. This embodiment is referred to as the "Visor" design of the Cap-in-Cap CRC. This refers to the structure wherein the upper lid is not solid, but forms a frame around the periphery with no hollow center portion. FIGS. 3A-3C describes a Cap-in-Cap CRC vial that can be injection molded in one piece. If the overlay does not contain a top, the first portion 44 contains the thumb tab 48, tubular skirt 40, and tab 42 and the second portion 46 contains hinges 54A and 54B and supports 56A and 56B. The hinges 54A and 54B are each attached to a support 56A and 56B, respectively. The supports 56A and 56B are perpendicular to the tubular skirt 40 and are on opposing sides of the hinge 50. The supports are located between hinges 54A and 54B and hinge 50. A portion of the supports is affixed to the solid base's tubular skirt 34.

Figure 1C:
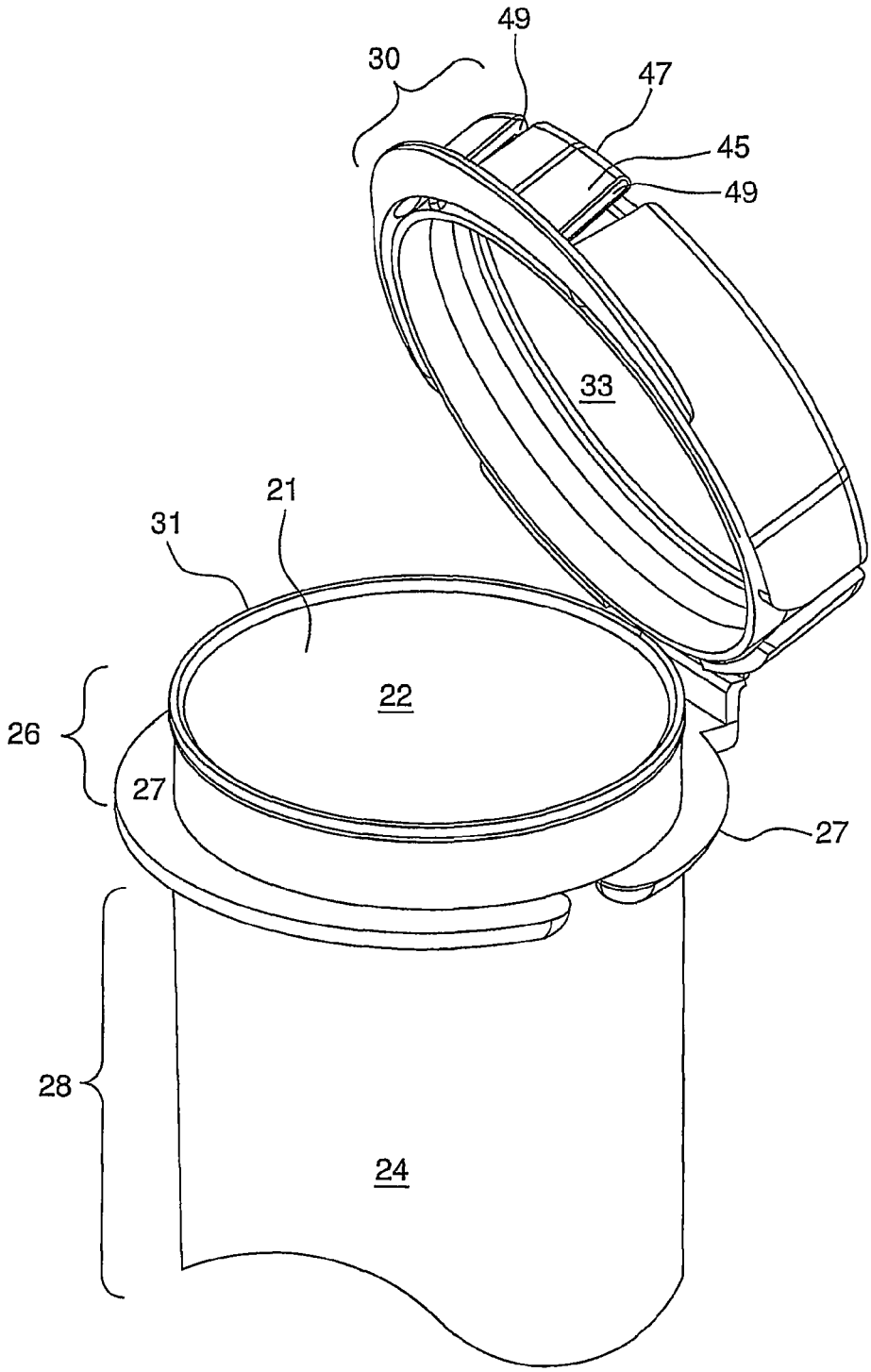
Figure 2:
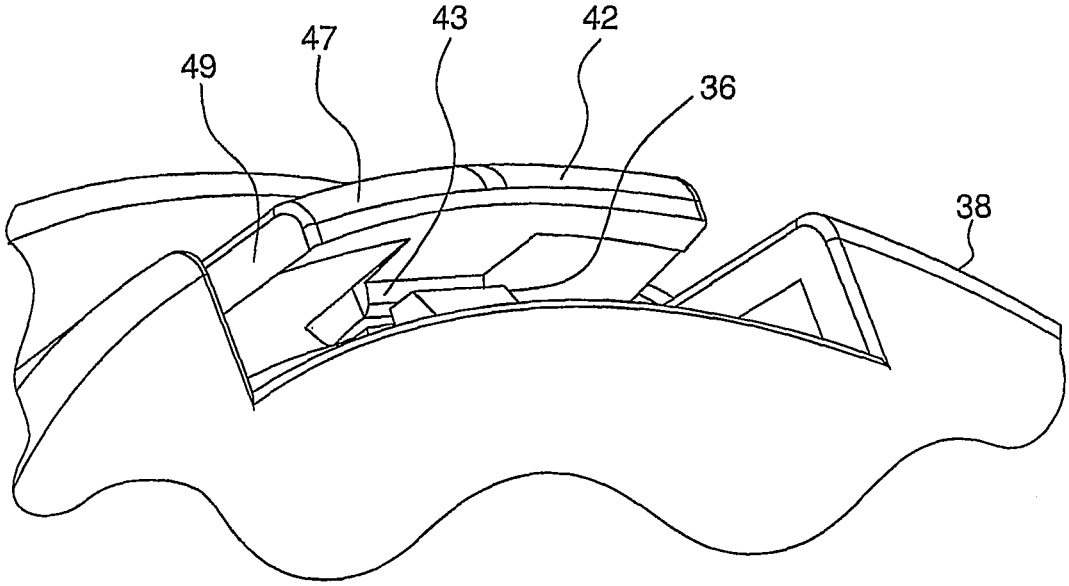
FIG. 2 is an exploded view of the tab and prong that connect to open the container.

In another embodiment, the overlay does not contain a top. This embodiment is shown in FIGS. 1A-1C of the Cap-in-Cap that can be injection molded in two pieces. The upper lid is assembled onto the vial outside the mold. If the overlay contains a top 60 does not contain a top, or only contains a portion of a top, the overlay must be of a suitable size so that only the first portion 44 is lifted, when only and upward force is applied to the thumb tab 48. Additionally, it must be of a suitable size so that both the overlay 38 (including both the first portion 44 and the second portion 46) and the solid base 32 are lifted, when sufficient inward force is applied to the tab 42 while simultaneously an upward force is applied to the thumb tab 48.

If the overlay does not contain a top, the second portion 46 may be secured to the solid base 32 in any suitable way as long as the supports 56A and 56B remain secured to the solid base's tubular skirt 34 when an upward force is applied only to the thumb tab or when a sufficient upward force is applied to the thumb tab in combination with a sufficient inward force applied to tab 42 to open the cap. If the overlay contains a top, the second portion 46 may be secured to the solid base 32 in any suitable way as long as the second portion 46 remains secured to the solid base 32 when an upward force is applied only to the thumb tab or when a sufficient upward force is applied to the thumb tab while simultaneously applying a sufficient inward force to tab 42 to open the cap. Suitable methods of securing include molding, co-molding, in-mold, and adhesion methods.

When the cap 30 is closed, the overlay 38 is secured directly over the cap's solid base 32. If an upward force is only applied to the thumb tab 48, then the first portion 44 of the overlay is lifted up and the overlay bends at the top hinge 62, if the overlay contains a cover, or the overlay bends at hinges 54A and 54B, if the overlay does not contain a cover, so that the second portion 46 remains fixed. This motion results in the solid base 32 of the cap remaining secured to the container 20.

If an upward force is applied to the thumb tab 48 while simultaneously a sufficient inward force is applied to tab 42 so that it contacts and connects with prong 36, then the solid base 32 is lifted up along with the first portion 44 of the overlay. This motion results in opening the container.

A "sufficient force" is a force above a threshold that causes tab 42 to contact and connect with prong 36, and allows the solid base 32 to be lifted up along with the first portion 46 of the overlay resulting in an open container. Children who are of an age at which they cannot comprehend the dangers of taking medicines unintended for them, or large doses of medicines, etc., do not generally possess the strength necessary to apply a force at or above the threshold. The degree of force that is required to lift the solid base 32 and second portion 46 along with the first portion 44 can be varied based on at least the following: the material of construction, the size of the notch, the location of the recess, the shape and depth of the recess and the size of the thumb tab.

A person of ordinary skill in the art would understand how to construct tab 42 so that it bends only upon application of a sufficient force. In one embodiment, the cap includes a suitable amount of elastomer in the thermoplastic formulation used to construct tab 42 to allow the tab to bend without breaking.

Figure 5:
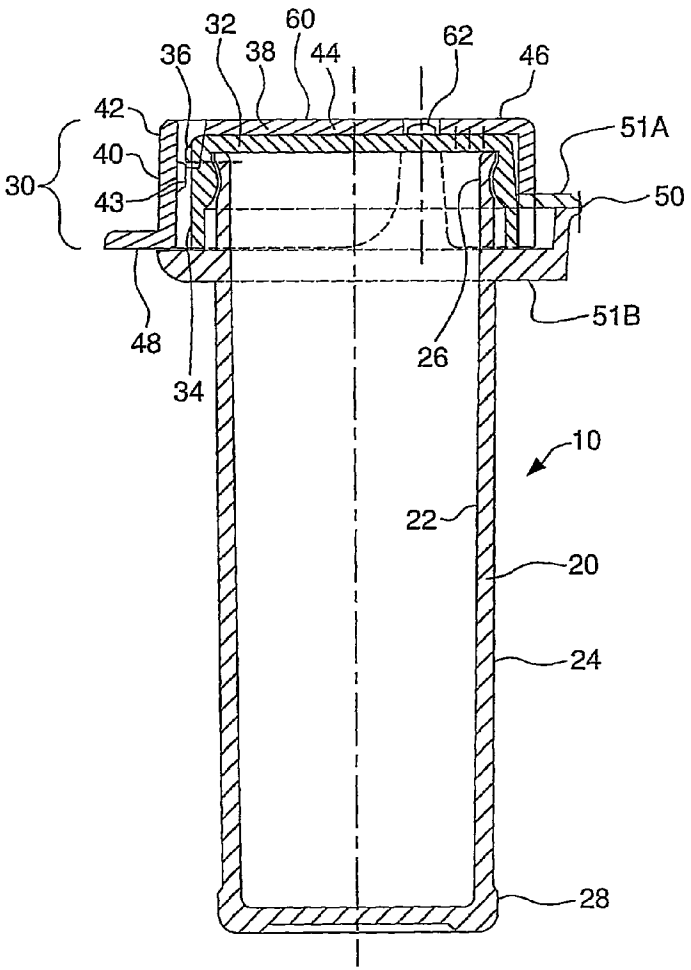
FIG. 5 is a view similar to FIG. 4, showing the overlay seated over the cap.
Figure 4:
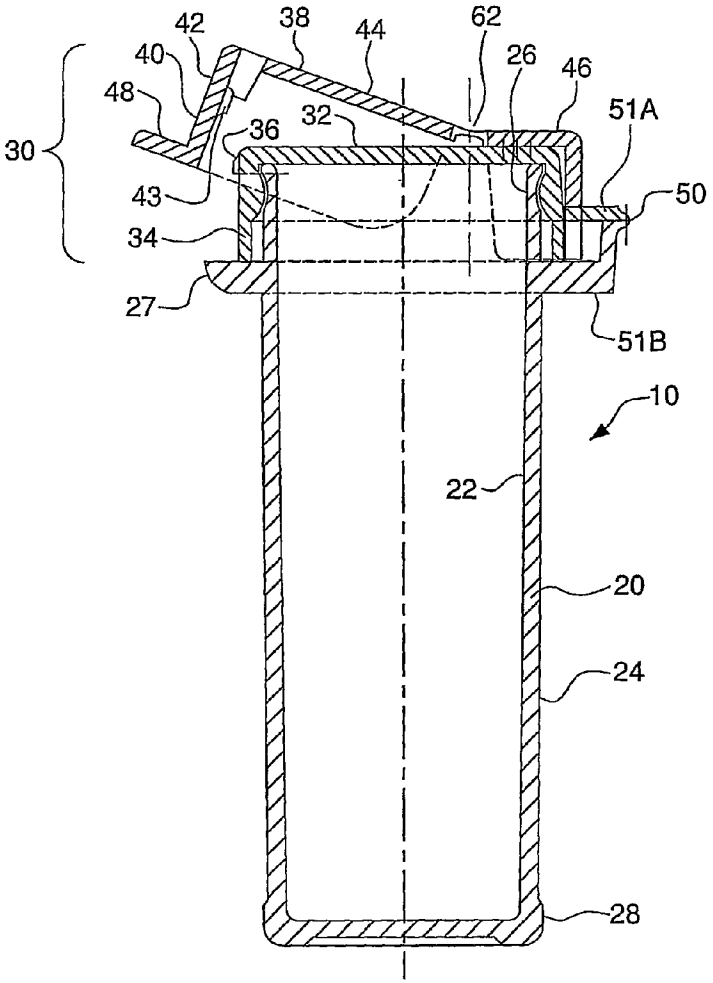
FIG. 4 is an axial section of another embodiment of the invention, showing the overlay lifted and the cap seated beneath it. Corresponding parts bear the same reference characters.
Figure 6:
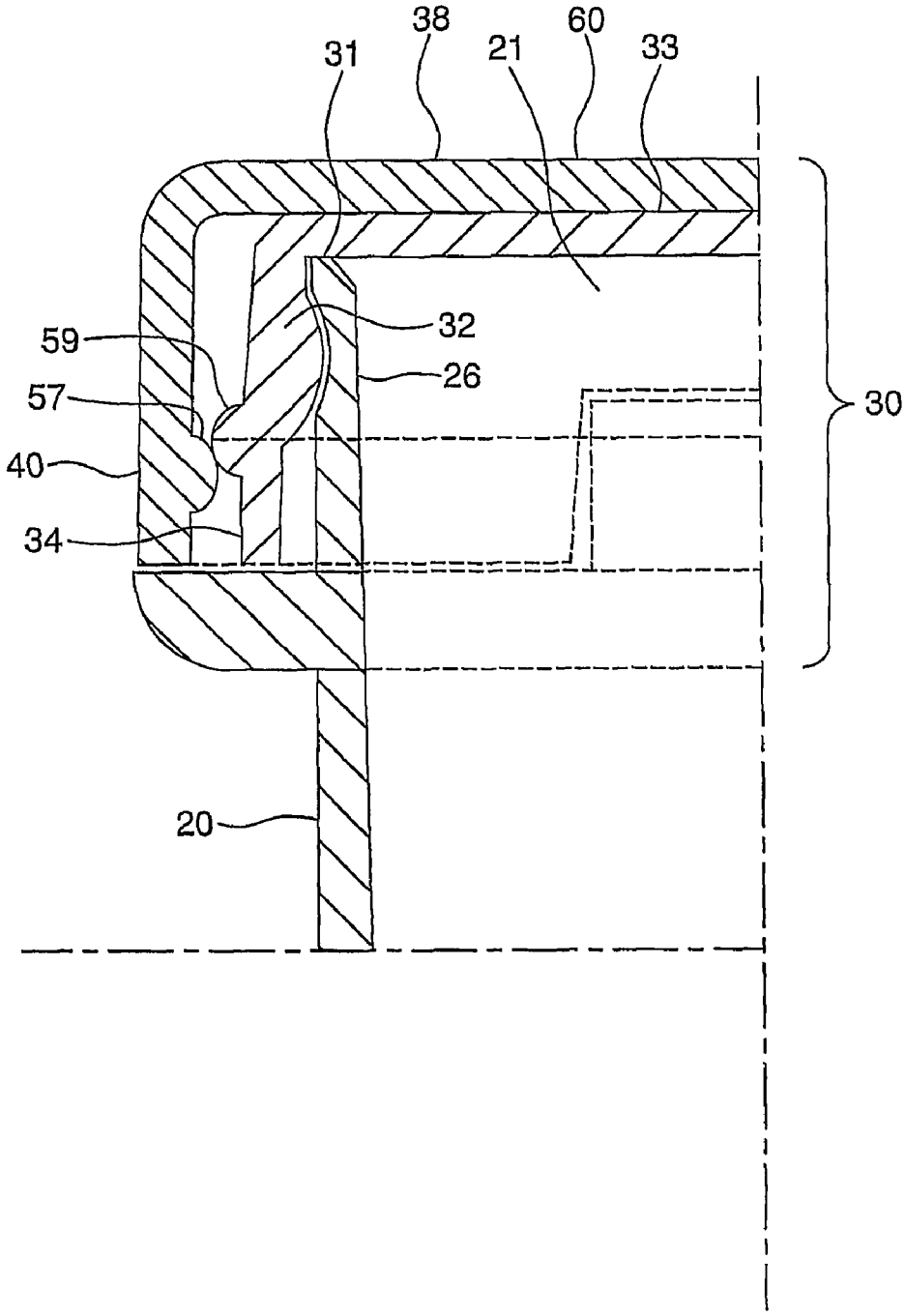
FIG. 6 is a partial axial half-section of the closure and container of FIGS. 4 and 5, circumferentially displaced about the circumference of the container compared to those Figures to show the engagement of the snap fittings 57 and 59 (also shown separated in the embodiment of FIG. 1B).

Referring to FIGS. 4-6, another embodiment is illustrated of a lift-top closure 30 for removably seating on a rim 31 of a container 20 to form a child-resistant container 20. The corresponding parts of this embodiment are numbered using the same reference characters as in previous figures. This description also has application to the embodiments of FIGS. 1-3.

The closure 30 has a lift-top cap 32 having a web 33, a depending skirt 34, and a cap abutment 36 on the skirt 34. The cap 32 is adapted to at least substantially cover and engage a rim 31 of the container 20. In an embodiment the closure 30 can have a cap hinge 50 for securing the lift-off cap 32 to the container 20. In an embodiment, the cap abutment 36 projects outward from the skirt 34.

The closure 30 can include, in an embodiment, an overlay 38 having a radially flexible tab 42, which in this embodiment is a part of the skirt 40 without notches or other relief separating the distal parts of the tab 42 from the skirt 40. In an embodiment, the overlay 38 can comprise at least a partial skirt 40 overlying at least a portion of the skirt 34 of the lift-top cap 32. In an embodiment, the overlay 38 can comprise a first portion 44 having the tab 42 and a second portion 46 secured to at least one of the lift-off cap 32 and the container 20. In an embodiment, the first and second portions 44 and 46 of the overlay 38, or either of them, can define the at least partial skirt 40.

The overlay 38 has a force-receiving element such as the thumb tab 48 illustrated, a high-friction pad, or another arrangement for transmitting a manual lifting force to the overlay 38. The cap 32 is openable by deflecting the tab 42 to engage the cap abutment 36 with the tab abutment 43, while lifting the force-receiving element 48 to raise the cap abutment 36 to its lifted position.

In an embodiment, the closure 30 can have a snap fitting including a portion 57 on the overlay 38 and a portion 59 on the cap 32. Portions of two circumferentially displaced pairs of snap fittings 57 and 59 are also shown in FIG. 1B. The snap portions 57 and 59 can be selectively engageable to maintain the overlay 38 in its lowered position and disengageable by an overlay lifting force to raise the overlay 38. In an embodiment the overlay lifting force is less than the force sufficient to unseat the cap 32 from a rim 31 of the container 20.

In an embodiment, a child-resistant lift-top container assembly 10 includes a container 20 having a rim 31 defining a mouth 21. The assembly 10 can have a lift-top cap 32 for seating on the rim to close the mouth, an overlay 38, a tab 42, a tab abutment 43, a force-receiving element 48, and an overlay hinge (62 or 54A and 54B), as previously described.

Referring to FIGS. 4-6, an embodiment is illustrated of a lift-top closure 30 for removably seating on a rim 31 of a container 20 to form a child-resistant container 20. The corresponding parts of this embodiment are numbered using the same reference characters as in previous figures. This description also has application to the embodiment of FIGS. 1-3.

The closure 30 has a lift-top cap 32 having a web 33, a depending skirt 34, and a cap abutment 36 on the skirt 34. The cap 32 is adapted to at least substantially cover and engage a rim 31 of the container 20. In an embodiment the closure 30 can have a cap hinge 50 for securing the lift-off cap 32 to the container 20. In an embodiment, the cap abutment 36 projects outward from the skirt 34.

Those skilled in the art will recognize, or be able to ascertain using no more than routine experimentation, many equivalents to the specific embodiments of the invention described herein. Such equivalents are intended to be encompassed by the following claims.

I claim:

1. A lift-top closure for removably seating on a rim of a container to form a child-resistant container, the closure comprising:

A. a lift-top cap comprising a web, a depending skirt, and a cap abutment on the skirt, the cap being adapted to at least substantially cover and engage a rim of a container when in a closed position and provide access to an internal cavity in the container when in an open position; and B. an overlay comprising a radially flexible tab having a rest position and a radially inwardly deflected working position, the tab being positionable substantially radially outside the cap abutment, the tab including a tab abutment normally disengaged from the cap abutment when the tab is in its rest position and engaged beneath the cap abutment for lifting the cap abutment when the tab is deflected to its working position, the overlay further comprising a force-receiving element for transmitting a manual lifting force to the overlay; at least a portion of the cap being pivotably displaced with at least a portion of the overlay from the closed position to the open position by deflecting the tab to engage the cap abutment with the tab abutment while lifting the force-receiving element to raise the cap abutment to its lifted position.

2. The closure of claim 1, further comprising a hinge joining the overlay to at least one of the cap and a container and enabling the overlay to pivot between a lowered position at which the tab abutment is positionable to engage the cap abutment, when the tab is deflected to its working position, and a lifted position above the lowered position.

3. The closure of claim 1, wherein the overlay comprises at least a partial skirt overlying at least a portion of the skirt of the lift-top cap.

4. The closure of claim 1, further comprising a cap hinge for securing the lift-off cap to a container and the pivotable displacement of the lift-off cap between the open and closed positions.

5. The closure of claim 1, wherein the overlay comprises a first portion comprising the tab and a second portion secured to at least one of the lift-off cap and a container.

6. The closure of claim 5, further comprising a hinge joining the first and second portions of the overlay.

7. The closure of claim 5, wherein the first and second portions of the overlay together comprise at least a partial skirt overlying at least a portion of the skirt of the lift-top cap.

8. The closure of claim 1, wherein the cap abutment projects outward from the skirt.

9. The closure of claim 1, wherein the tab abutment projects inward from the tab.

10. The closure of claim 1, wherein the overlay further comprises a body portion to which the tab is secured, the tab has a proximal portion and a distal portion, the proximal portion of the tab is integral with the body portion, and the distal portion of the tab has a periphery spaced from the body portion.

11. The closure of claim 1, further comprising a snap fitting on the overlay and the cap selectively engageable to maintain the overlay in a lowered position and disengageable by an overlay lifting force to raise the overlay to a raised position, the overlay lifting force being less than a force sufficient to unseat the cap from a rim of a container.

12. A child-resistant lift-top container assembly comprising:

A. a container comprising a rim defining a mouth;

B. a lift-top cap comprising a web, a depending skirt, and a cap abutment on the skirt, the cap being adapted to at least substantially cover and engage a rim of the container when in a closed position and provide access to an internal cavity in the container when in an open position;

C. an overlay comprising a radially flexible tab having a rest position and a radially inwardly deflected working position, the tab being positionable radially outside the cap abutment, the tab including a tab abutment normally unengaged with the cap abutment when the tab is in its rest position and engaged beneath the cap abutment for lifting the cap abutment when the tab is deflected to its working position, the overlay further comprising a force-receiving element for transmitting a manual lifting force to the overlay; and D. an overlay hinge joining the overlay to at least one of the cap and the container and enabling the overlay to pivot between a lowered position at which the tab abutment is positionable to engage the cap abutment, when the tab is deflected to its working position, and a lifted position above the lowered position; at least a portion of the cap being pivotably displaced with at least a portion of the overlay from the closed position to the open position by deflecting the tab to engage the cap abutment with the tab abutment, while lifting the force-receiving element to raise the cap abutment to its lifted position.

* * * * *